US006431351B1

(12) United States Patent
Lin

(10) Patent No.: US 6,431,351 B1
(45) Date of Patent: Aug. 13, 2002

(54) CASE FOR A PAIR OF FAR-SIGHTED EYEGLASSES

(76) Inventor: Linus Lin, P.O. Box 90, Tainan City (TW)

( * ) Notice: Subject to any disclaimer, the term of this patent is extended or adjusted under 35 U.S.C. 154(b) by 59 days.

(21) Appl. No.: 09/766,621

(22) Filed: Jan. 23, 2001

(51) Int. Cl.[7] ..... B65D 71/00

(52) U.S. Cl. ..... 206/224; 206/5; 206/6; 206/214

(58) Field of Search ..... 206/5, 6, 214, 206/224, 371

(56) References Cited

U.S. PATENT DOCUMENTS 1,955,613 A * 4/1934 Theilengerdes ..... 206/5
2,203,402 A * 6/1940 Bausch ..... 206/6
2,330,152 A * 9/1943 Spence ..... 40/651
2,479,472 A * 8/1949 Coplon ..... 206/37
2,809,766 A * 10/1957 Anderson ..... 220/326
3,323,638 A * 6/1967 Dishart ..... 132/75
5,016,749 A * 5/1991 Kaye et al. ..... 206/5.1
5,495,938 A * 3/1996 Bedford et al. ..... 206/763
5,921,383 A * 7/1999 Shefler et al. ..... 206/5
5,929,967 A * 7/1999 Conner ..... 351/158

* cited by examiner

*Primary Examiner*—Mickey Yu
*Assistant Examiner*—Troy Arnold

(57) ABSTRACT

A case for a pair of far-sighted eyeglasses includes an upper and a lower half case, a pair of far-sighted eyeglasses and a pen. The upper and the lower half case have a soft cloth, and the lower half case has a position block in an intermediate portion to stabilize the far-sighted eyeglasses with the nose bridge of the far-sighted eyeglasses lying on the position block. The lower half case has a shaped retaining block respectively at two opposite sides for keeping a pen stably. Thus the case contains both the pair of far-sighted eyeglasses and the pen for carrying to wear and write. A hang hook is also provided on an outer surface of the upper half case to be hanged on a pocket.

2 Claims, 7 Drawing Sheets

CASE FOR A PAIR OF FAR-SIGHTED EYEGLASSES

BACKGROUND OF THE INVENTION

1. Field of the Invention

This invention relates to a case for a pair of far-sighted eyeglasses, particularly to one having a shaped position block and two shaped retaining blocks in proper locations in the case for stabilizing the far-sighted eyeglasses and the pen, and further a hang hook provided on an outer surface of the upper half case for hanging the case on a pocket for carrying.

2. Description of the Prior Art

Common conventional far-sighted eyeglasses are usually used for reading. As such, they cannot be always worn by a user, but only intended to be usually carried in a case by a user for need of reading. But the case has to be opened with some force, if an excessive force is used to open the case, the pair of far-sighted eyeglasses contained in the case may fall out and down on the ground and damaged or with lenses broken. Some far-sighted eyeglasses are collapsible to become a small size for easily carrying, having a turning point between the two lens rims a hand rod screwed with the sides of the leans rims. This permits the eyeglasses to be folded with one lens rim lad on the other lens rim, with the hang rod extending horizontal facing upward to from a T shape. Then the hand rod is folded down on the lens rims. The collapsed eyeglasses are then put into a curved case the size of a lighter. But this kind of eyeglasses involves complicated steps, often letting users to lose or damage the eyeglasses by carelessness.

SUMMARY OF THE INVENTION

The objective of the invention is to offer a case for a pair of far-sighted eyeglasses and a pen, having a simple structure to be easily opened and carried along.

The feature of the invention is the case consisting of an upper and a lower half case pivotally connected to each other to allow the upper half case to be opened up and closed on the lower half case. Further, a position block and two retaining blocks are provided in the lower half case for keeping a pair of far-sighted eyeglasses and a pen in place in the case.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
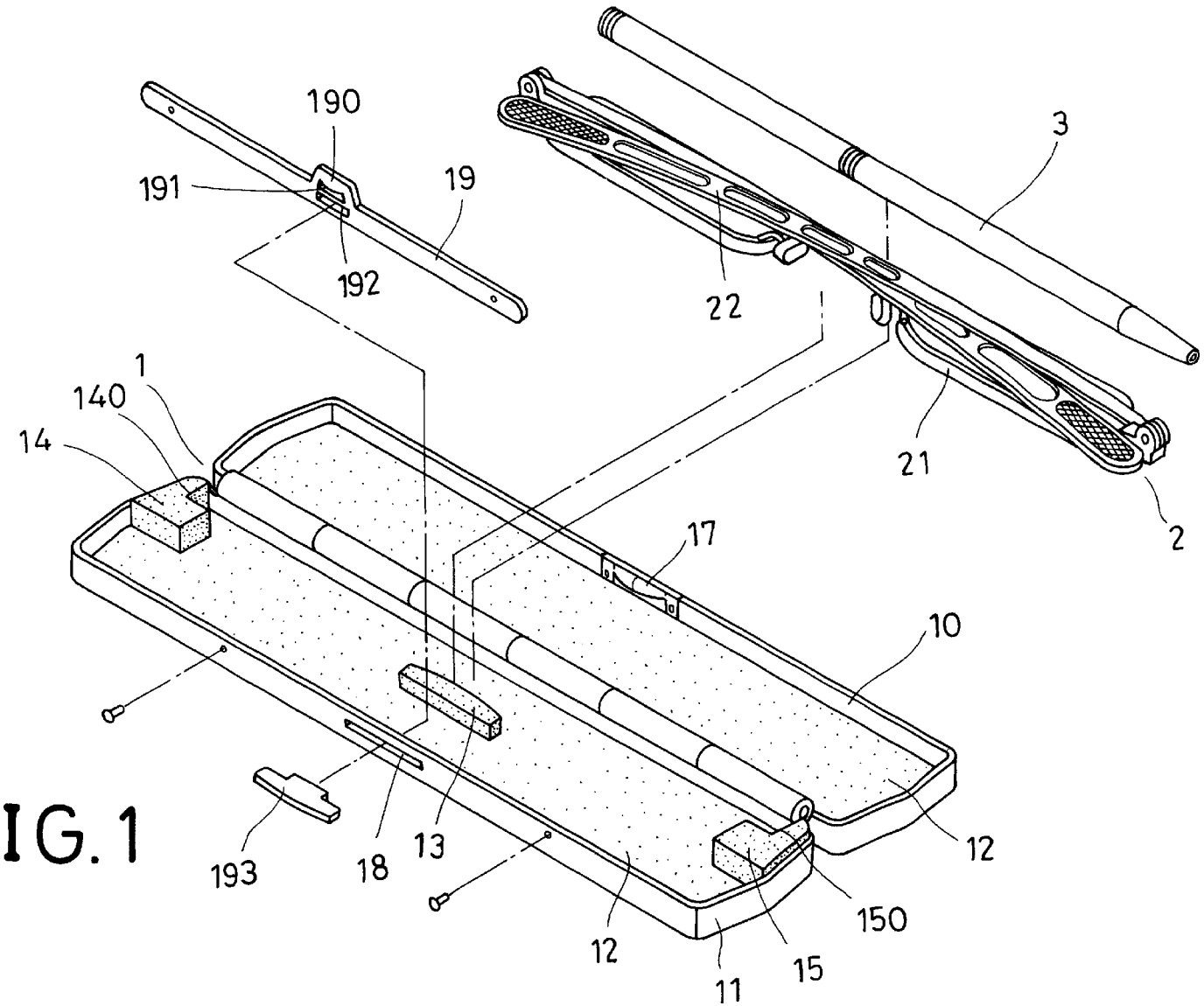
FIG. 1 is an exploded perspective view of a case for a pair of far-sighted eyeglasses in the present invention.

A preferred embodiment of a case for a pair of far-sighted eyeglasses in the present invention, as shown in FIG. 1, includes a case 1, a pair of far-sighted eyeglasses 2 and a pen as main components.

Figure 2:
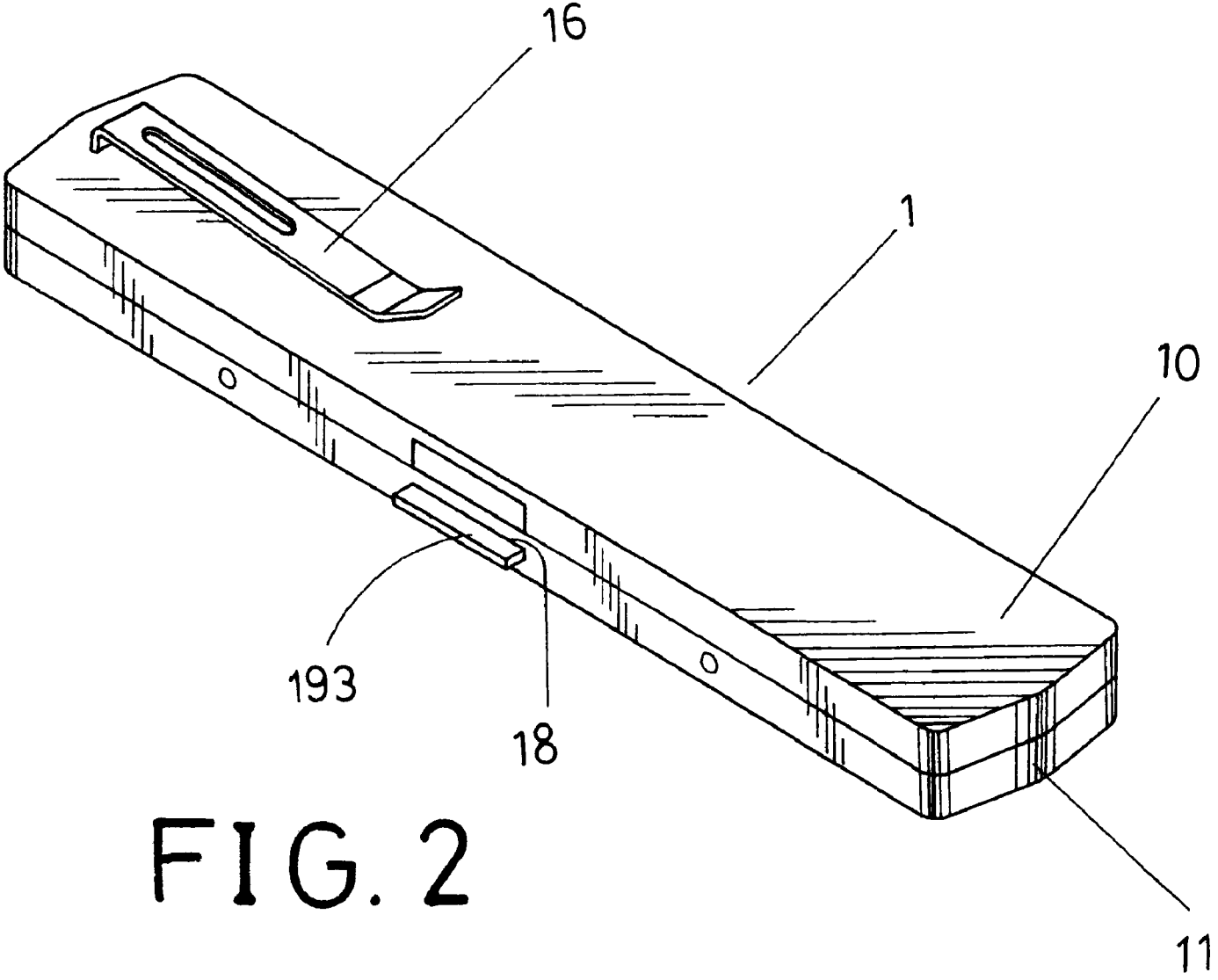
FIG. 2 is a perspective view of the case containing the far-sighted eyeglasses in the present invention.

The case 1 is elongate, consisting of an upper half case 10 and a lower half case 11, with the upper half case 10 pivotally connected to the lower half case 11 so as to be opened and closed on the lower half case 11. Further, a sheet of soft cloth lining 12 is respectively laid in the upper and the lower half case 10 and 11, which has a shaped position block 13 fixed on an intermediate portion of the inner surface, and a left L shaped retaining block 14 and a right L shaped retaining block 15 are respectively fixed at two inner opposite ends. The left and the right shaped retaining block 14 and 15 respectively have a cut-off corner 140, 150. In addition, a hang hook 16 is fixed on an outer surface of the upper half case 10, as shown in FIG. 2 for hanging the case 1 on a pocket. A hook block 17 is provided on an intermediate portion of a front wall of the upper half case 11, and a slot 18 is provided in a front wall of the lower half case 11. Further, a long elastic strip is riveted on the inner side of the front wall of the lower half case 11, having a slide surface 190 protruding upward in the intermediate portion, a fit slot 191 provided a little below the slide surface 190, and an insert slot 192 provided a little below the fit slot 191 for a press block 193 to insert therein and also extending out of the slot 18 of the front wall of the lower half case 11.

Figure 3:
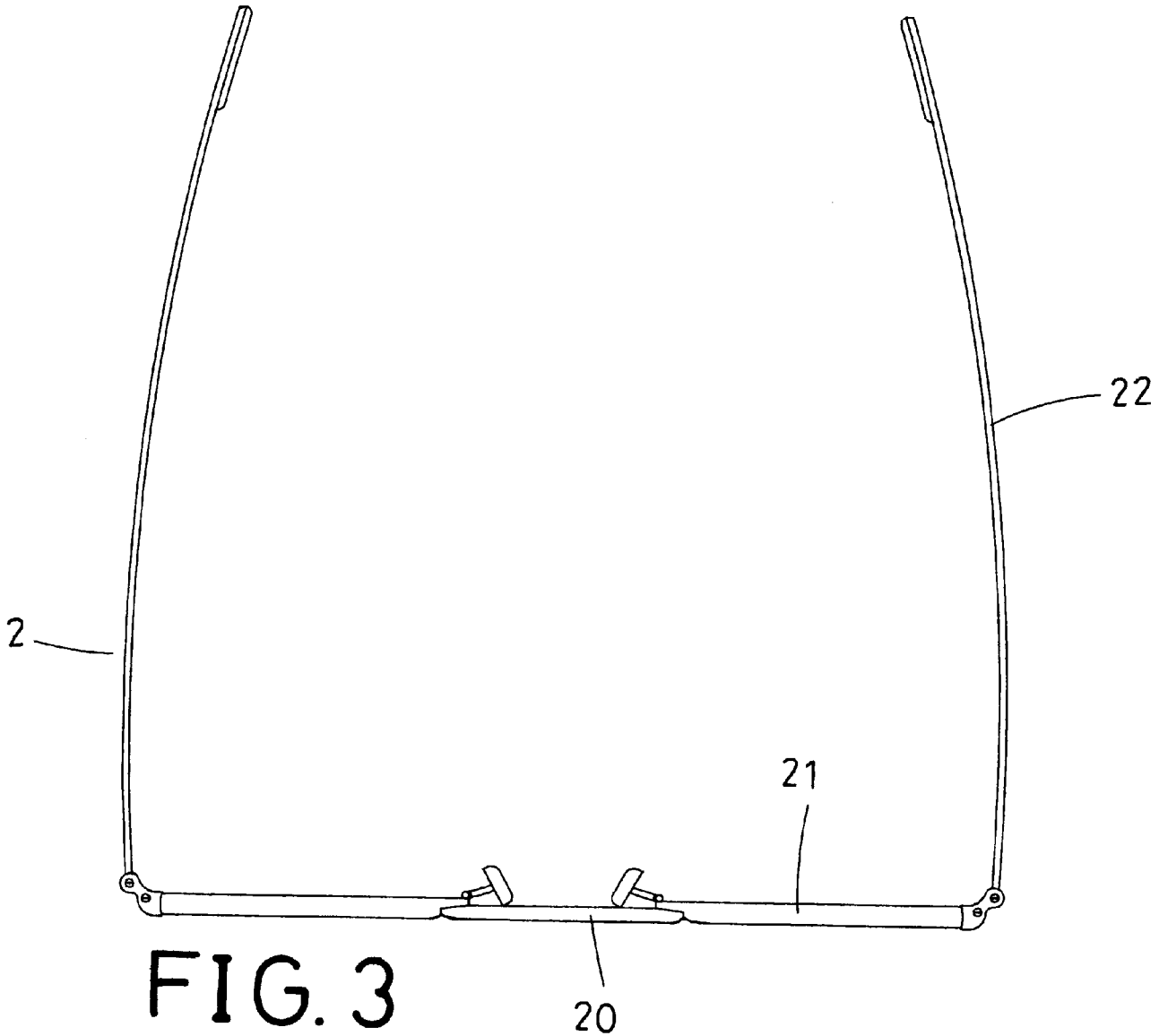
FIG. 3 is an upper view of the far-sighted eyeglasses in the present invention.

The far-sighted eyeglasses 2 are to be placed in the case 1, having a nose bridge 20 as shown in FIG. 3, a lens rim 21 respectively formed at two sides of the bridge 20, and a flat curved temple 3 respectively connected to an outer side of each two lens rim 21.

The pen 3 is placed in an upper inner portion of the case 1, with two ends tightly contacting with the cu-off corners 140, 150 of the right and the left retaining block 15 and 14.

Figure 4:
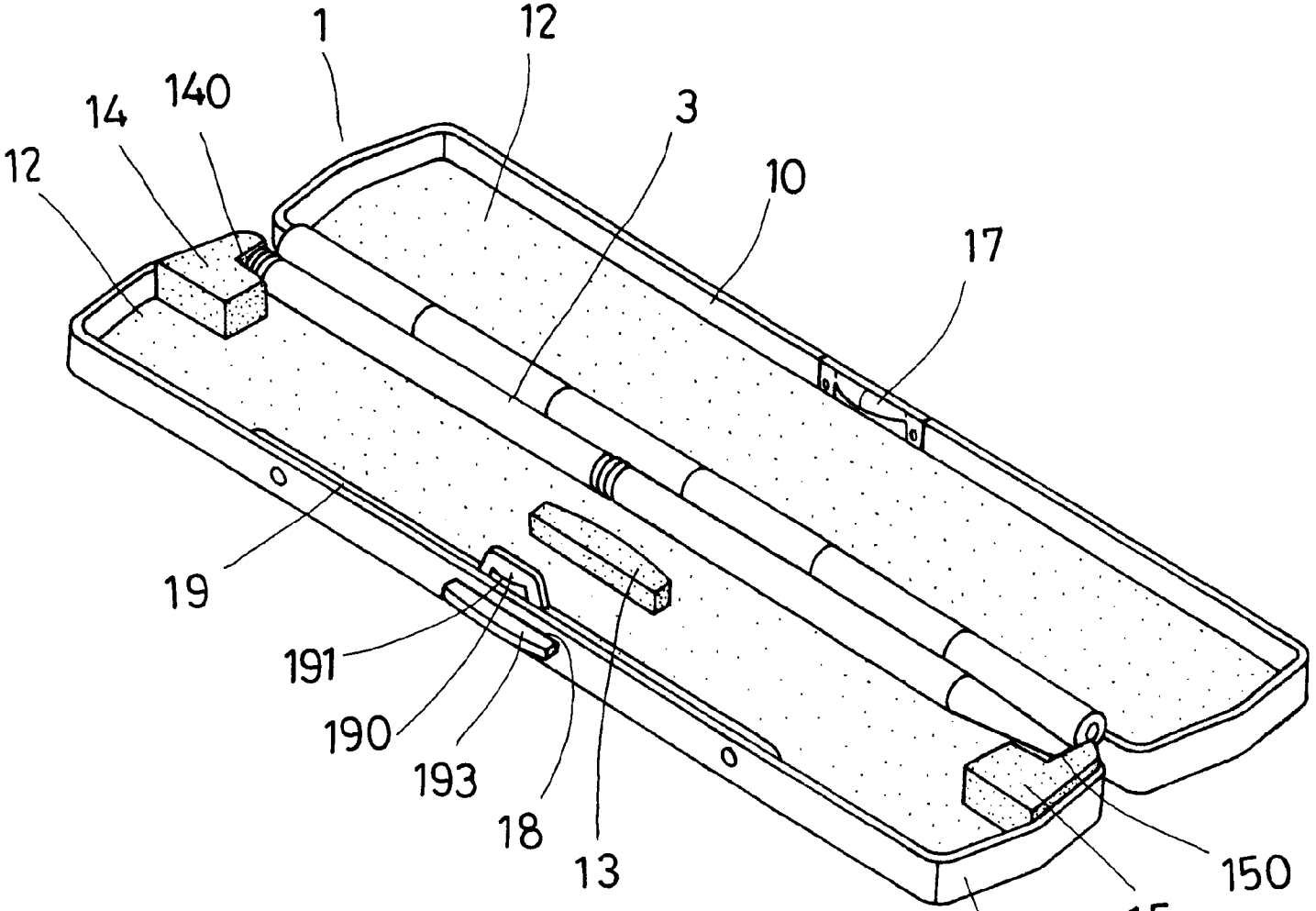
FIG. 4 is a perspective view of a pen placed in a lower half case with an upper half case opened in the present invention.
Figure 5:
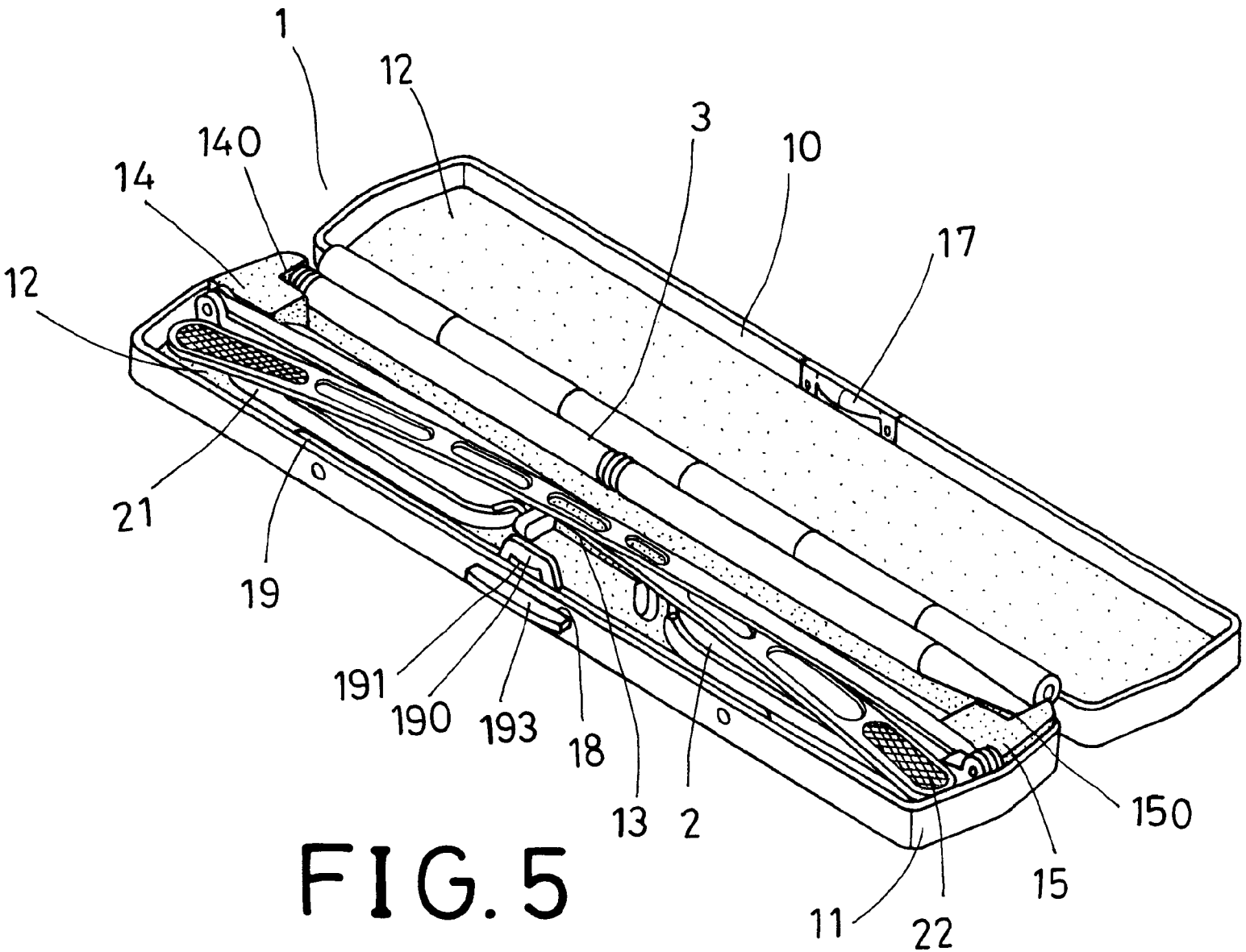
FIG. 5 is a perspective view of the pen and the far-sighted eyeglasses placed in the lower half case with the upper half case opened in the present invention.
Figure 6:
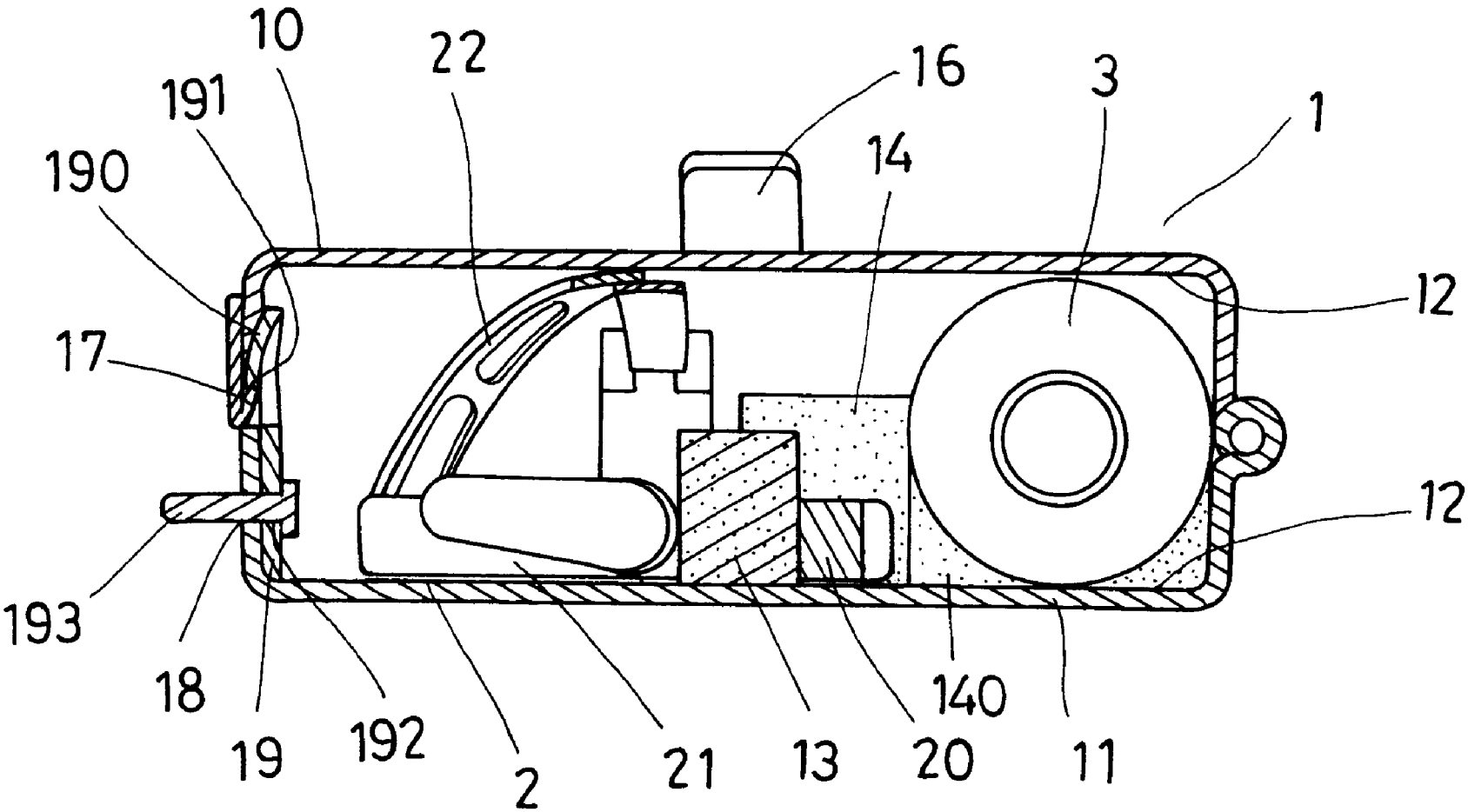
FIG. 6 is a cross-sectional view of the case for a pair of far-sighted eyeglasses and the pen placed in the case in the present invention; and, FIG. 7 is a side view of the far-sighted eyeglasses compressed in the present invention.
Figure 7:
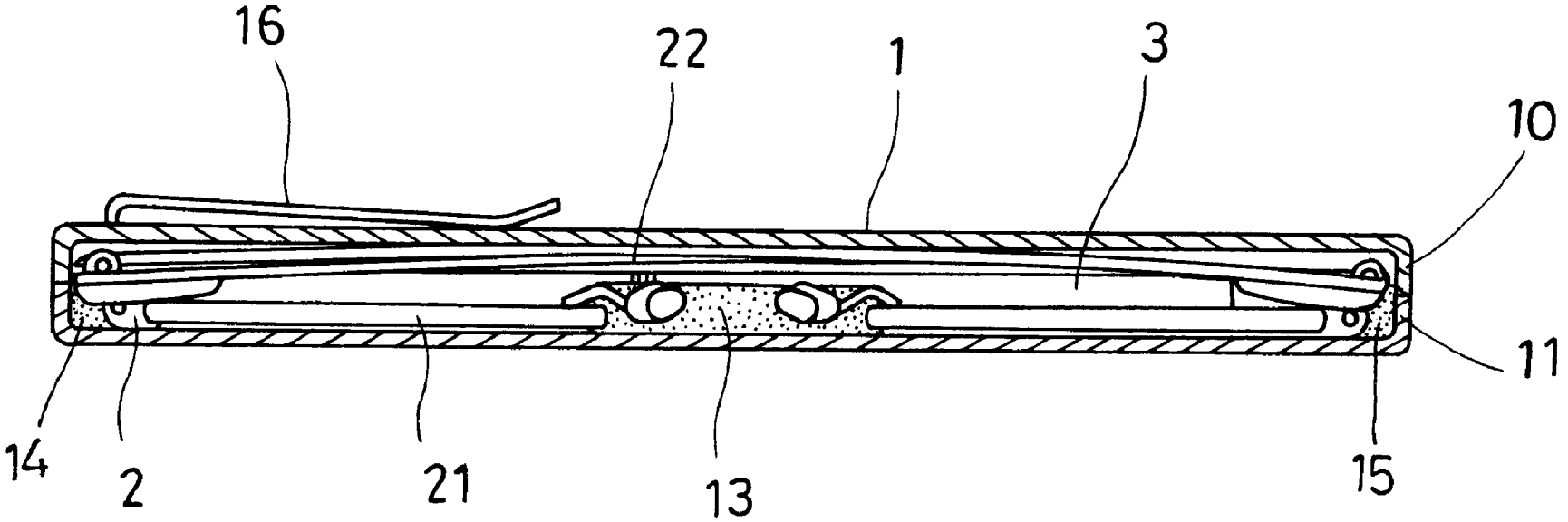

In assembling and using, referring to FIGS. 4, 5 and 6, firstly put the pen 3 in the space between the two retaining blocks 14, 15 in the lower half case 11, with its two ends tightly contacting the two cut-off corners 140, 150 in a stabilized condition. Then the two temples 22 are folded down, with the two-lens rims 21 placed downward in the lower half case 11 protectively on the soft cloth 12. The soft cloths 12 also protect the far-sighted eyeglasses and the pen from wear and tear. The nose bridge 20 of the eyeglasses just fits the position block 13 and stabilized thereby, and two ends of the eyeglasses 2 respectively tightly contact lower edges of the two retaining blocks 14, 15 keeping the eyeglasses 2 and the pen 3 from swaying or moving around when receiving a shock. As the two temples 22 are curved up, protruding up the upper edge of the lower half case 11, the hook block 17 may slide along the slide surface 190 and enter the insert hole 191 when the upper half case 11 is closed on the lower half case 11, as shown in FIG. 6. Then the upper half case 10 may compress the curved temples 22 placed in the lower half case 11, as shown in FIG. 7. If a user wants to open the case 1, the person only presses inward the press block 193 in the slot 18, forcing the insert hole 191 of the elastic strip 19 move back and letting the hook block 17 disengage from the elastic strip 19, with the temples 22 also released from compressing by the upper half case 10 to recover elastic force to push a little the upper half case 10 off the lower half case 1. Thus the case 1 is easily opened, having a very small dimensions and the hang hook 16 can hang the case 1 on a pocket for easily carrying.

While the preferred embodiment of the invention has been described above, it will be recognized and understood that various modifications may be made therein and the appended claims are intended to cover all such modifications that my fall within the spirit and scope of the invention.

What is claimed is:

1. A case, for a pair of far-sighted eyeglasses and a pen comprising:

an upper half case and a lower half case, a soft cloth lining in said upper and said lower half case respectively, and a position block provided in an intermediate portion in said lower half case;

a pair of far-sighted eyeglasses placed on an inner side of a lower portion of said lower half case, and a nose bridge of said far-sighted eyeglasses kept in place with said position block in a stabilized condition; and, characterized by said lower half case being provided with two shaped retaining blocks positioned parallel to a position where said far-sighted eyeglasses are laid, a pen kept sustained between said two retaining blocks in said lower half case, thus both said far-sighted eyeglasses and said pen are contained in said case, said shaped position block keeping said far-sighted eyeglasses in place immovable, said two shaped retainable blocks keeping immovable said pen, said far-sighted eyeglasses and said pen resistant to wear or tear caused by shocks or vibration, said case being small and thin so as to easily carry and wear said far-sighted eyeglasses and to write with said pen when needed.

2. The case for a pair of far-sighted eyeglasses and a pen claimed in claim 1, wherein said two shaped retaining blocks are L-shaped, located oppositely, each having a notch for two ends of said pen to fit in.

* * * * *